US009711925B2

(12) United States Patent
Biesse et al.

(10) Patent No.: US 9,711,925 B2
(45) Date of Patent: Jul. 18, 2017

(54) METHOD FOR CONNECTING THE CONDUCTORS OF A FLEXIBLE BONDED (EQUIPOTENTIAL) CONNECTION LAYER

(71) Applicant: LABINAL POWER SYSTEMS, Blagnac (FR)

(72) Inventors: Jean-Luc Biesse, Saint Lieux les Lavaur (FR); Arnaud Camille Ayme, Toulouse (FR); Florian Barraud, Meilhac (FR); David Boutot, Lascaux (FR)

(73) Assignee: LABINAL POWER SYSTEMS, Blagnac (FR)

( * ) Notice: Subject to any disclaimer, the term of this patent is extended or adjusted under 35 U.S.C. 154(b) by 179 days.

(21) Appl. No.: 14/396,592

(22) PCT Filed: Apr. 18, 2013

(86) PCT No.: PCT/FR2013/050865
§ 371 (c)(1),
(2) Date: Oct. 23, 2014

(87) PCT Pub. No.: WO2013/160592
PCT Pub. Date: Oct. 31, 2013

(65) Prior Publication Data

US 2015/0107893 A1 Apr. 23, 2015

(30) Foreign Application Priority Data

Apr. 27, 2012 (FR) ..... 12 53935

(51) Int. Cl.
*H01R 43/048* (2006.01)
*H01B 7/04* (2006.01)
(Continued)

(52) U.S. Cl.
CPC ..... *H01R 43/048* (2013.01); *H01B 5/00* (2013.01); *H01B 7/0045* (2013.01); *H01B 7/04* (2013.01);
(Continued)

(58) Field of Classification Search
CPC ..... Y10T 29/49222; Y10T 29/49181; Y10T 29/53209; Y10T 29/53217;
(Continued)

(56) References Cited

U.S. PATENT DOCUMENTS 4,636,024 A * 1/1987 Yahata ..... H01R 4/2404 439/449
5,535,512 A * 7/1996 Armogan ..... Y10T 29/49222 29/877
2010/0147585 A1* 6/2010 Kobayashi ..... H01R 43/048 174/84 C

FOREIGN PATENT DOCUMENTS

FR 2 826 518 12/2002
FR 2 918 508 1/2009
JP 2001015187 A * 1/2001

OTHER PUBLICATIONS

International Search Report issued Aug. 30, 2013 in PCT/FR13/050865 Filed Apr. 18, 2013.

* cited by examiner

*Primary Examiner* — A. Dexter Tugbang
(74) *Attorney, Agent, or Firm* — Oblon, McClelland, Maier & Neustadt, L.L.P.

(57) ABSTRACT

A method electrically connects by crimping electrical conductors in a connector for equipotential connection of a planar and flexible layer formed by the conductors, to metal components. The method includes positioning the electrical conductors in individual longitudinal and parallel cells which are formed between two planar walls of the connector,
(Continued)

crimping the conductors crimped in a crimping zone by simultaneous transverse punching of at least one wall of the connector, and forming by the transverse punching at least one corresponding transverse groove line on the at least one connector wall and, by load transfer, on each of the conductors to electrically connect the conductors.

6 Claims, 4 Drawing Sheets

(51) Int. Cl.

| | |
|---|---|
| ***H01R 43/16*** | (2006.01) |
| ***H01R 4/24*** | (2006.01) |
| ***H01R 4/20*** | (2006.01) |
| ***H01B 7/06*** | (2006.01) |
| ***H01R 4/64*** | (2006.01) |
| ***H01R 12/69*** | (2011.01) |
| ***H01B 5/00*** | (2006.01) |
| ***H01B 7/00*** | (2006.01) |
| ***H01R 43/042*** | (2006.01) |
| *H01R 4/18* | (2006.01) |
| *H01R 4/62* | (2006.01) |
| *H01R 31/08* | (2006.01) |
| *H01R 101/00* | (2006.01) |

(52) U.S. Cl.

CPC ..... *H01B 7/06* (2013.01); *H01R 4/20* (2013.01); *H01R 4/206* (2013.01); *H01R 4/24* (2013.01); *H01R 4/2404* (2013.01); *H01R 4/64* (2013.01); *H01R 12/69* (2013.01); *H01R 43/042* (2013.01); *H01R 43/0482* (2013.01); *H01R 43/16* (2013.01); *H01R 4/182* (2013.01); *H01R 4/62* (2013.01); *H01R 4/646* (2013.01); *H01R 31/085* (2013.01); *H01R 2101/00* (2013.01); *Y10T 29/49181* (2015.01); *Y10T 29/49222* (2015.01); *Y10T 29/53209* (2015.01); *Y10T 29/53217* (2015.01); *Y10T 29/53235* (2015.01); *Y10T 29/53239* (2015.01)

(58) Field of Classification Search

CPC ..... Y10T 29/53235; Y10T 29/53239; H01R 43/042; H01R 43/048; H01R 43/0482; H01R 43/16; H01R 12/69; H01R 31/085; H01R 2101/00; H01R 4/182; H01R 4/20; H01R 4/206; H01R 4/24; H01R 4/2404; H01R 4/62; H01R 4/64; H01R 4/646; H01B 5/00; H01B 7/0045; H01B 7/04; H01B 7/06

See application file for complete search history.

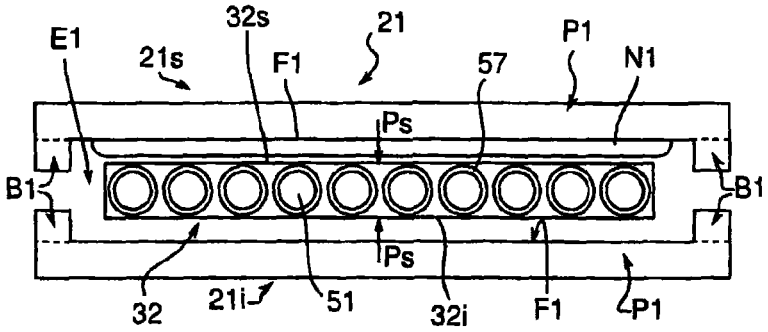
Figure 6a
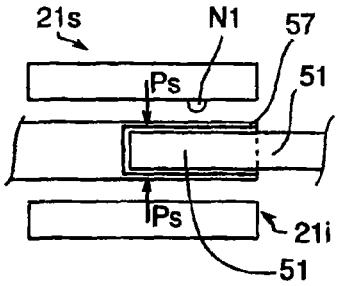
Figure 6b
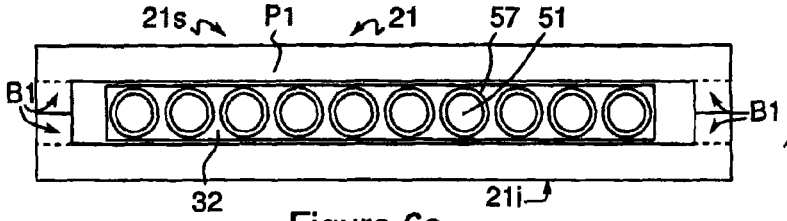
Figure 6c
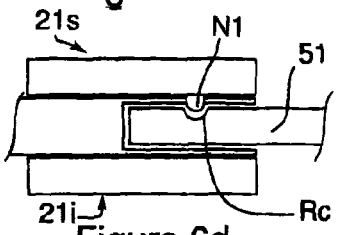
Figure 6d
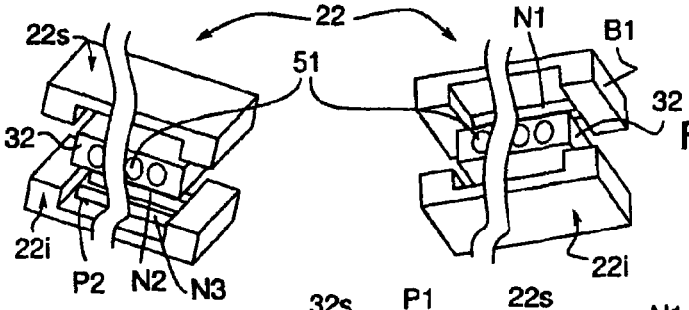
Figure 7a
Figure 7b
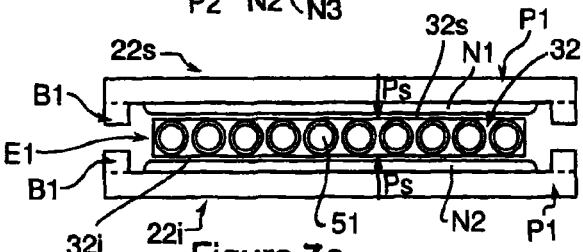
Figure 7c
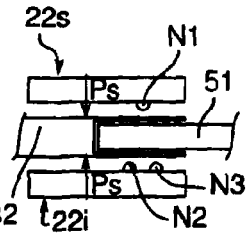
Figure 7d
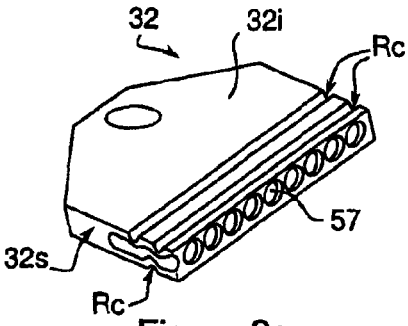
Figure 8a
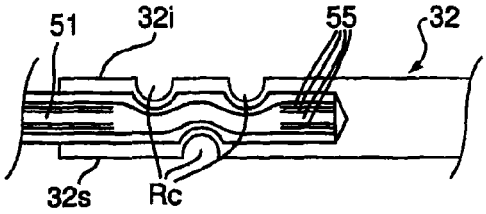
Figure 8b

METHOD FOR CONNECTING THE CONDUCTORS OF A FLEXIBLE BONDED (EQUIPOTENTIAL) CONNECTION LAYER

TECHNICAL FIELD

The invention relates to a method for connecting non-insulated electrical conductors of a flexible equipotential connection layer in order to connect metal components, in particular of electrical current return networks for new-generation aircraft having a skin which is made from a composite material. The invention also relates to a crimping tool which is capable of implementing this method, terminal and intermediate connectors for such conductors, and a wiring loom having a flexible equipotential connection layer which is provided with such connectors in order to connect such a conductor layer to said current return metal components.

The composite material of this new generation of skin comprises a heterogeneous material based on carbon fibres. Conventionally, the functions of electrical interconnection were carried out by the aluminium skin of the old generation. Aircraft manufacturers used it for the current return of consumption equipment, for the placement of all the metal components at the same potential, for EMC protection (electromagnetic compatibility) of the electrical installation and for lightning—indirect and induced—current flows and electrostatic charges flows.

The invention can also be used in any structure or building for the passage of electricity which requires the current to be placed in an equipotential state, in particular, but not exclusively, for fuselages of passenger cabins of aircraft having a composite skin.

PRIOR ART

Composite carbon materials are poor conductors of electricity and poorly withstand the heating actions brought about by the Joule effect. Such a coating cannot therefore be used in order to ensure the above functions.

In order to allow the functions of electrical interconnection to be implemented for an aircraft having a skin with a composite structure, there has thus been designed an architecture which is composed of components produced from metal in order to create an electrical network. Generally, this network is composed of three longitudinal networks which extend along the fuselage of the aircraft. With reference to the cross section of the passenger cabin of FIG. 1, the aircraft skin 5 of carbon material appears in the form of a curved wall to which there are fixed three portions of an example of a current return network 10: upper longitudinal portion 10*s*, central longitudinal portion 10*m* and lower longitudinal portion 10*i*.

The upper portion 10*s* of the network comprises a central support 11 and metal lateral supports 12. The central support 11 receives cabling and technical hardware, whilst the lateral supports 12 support the luggage compartments.

The central portion 10*m* is composed of a metal cross-member 14 on which the metal rails 15 of the passenger seats are mounted.

The lower portion 10*i* comprises another metal cross-member 16 for supporting metal cargo rails 18. Structural metal connection rods 19 connect the central metal cross-member 14 and the lower metal cross-member 16.

The upper, central and lower portions are interconnected by the transverse structural frame 20 of composite material based on carbon fibres. In this carbon frame 20, a flexible wiring loom 30 connects the supports 11 and 12 of the upper portion 10*s* to the central cross-member 14.

In the routing example of FIG. 1, the wiring loom 30 comprises two terminal connectors 32 which are fixed to the central support 11 and to the central cross-member 14, and an intermediate connector 34 which is fixed to a lateral support 12. The wiring loom 30 is composed of a planar layer 50 of conductors which are not electrically insulated and which are formed by cords of aluminium strands, together with the connectors 32 and 34. Such a wiring loom allows a routing in a tight space, for example between the carbon frame 20 and a thermophonic protection panel or a lining panel of the passenger cabin.

A mesh of electrical network is thus created in order to increase the operational reliability.

One of the critical points of this mesh involves the manner in which the intermediate connectors 34 and terminal connectors 32 are produced for connection between the layer of aluminium conductors 50 and the metal structures which constitute the aircraft current return network 10.

Conductor connections are conventionally produced using terminals and extension pieces for aluminium cables, or earthing module. However, these terminals, extension pieces or modules do not allow connections to be produced which are reproducible, uniform, fluid-tight and reliable with non-insulated multi-strand conductors of aluminium, a minimisation of the mass at low cost. In the aeronautical field in particular, these aspects of mass, uniformity of distribution of the forces, and cost are fundamentally important.

In particular, existing solutions do not allow the forces and connection resistances of the conductors to be distributed simultaneously, in an individual and homogeneous manner. Furthermore, the connections must be able to interface readily with the metal structures of the current return network. Furthermore, uniform crimping of several conductors cannot be carried out using known crimping tools which generally combine a punch and a die, or several punches which are diametrically opposed, in order to crimp each conductor individually. Furthermore, the known connectors do not allow reliable and lasting sealing to be ensured for a plurality of electrically non-insulated conductors of aluminium alloy, the sealing being ensured only by the insulating sheath of the cables with a connection of terminals or earthing modules.

STATEMENT OF INVENTION

An object of the invention is to provide a connection which is reproducible, uniform, fluid-tight and reliable both for intermediate and terminal connections of a wiring loom having a layer of conductors of the type described above. To this end, the invention makes provision for simultaneous crimping of the conductors in connectors by applying continuous and uniform pressure in a crimping zone.

More specifically, the present invention relates to a method for connecting by means of crimping electrical conductors in connectors for equipotential connection to metal components. These electrical conductors, which form a planar and flexible layer, are positioned in individual longitudinal and parallel cells which are formed between two planar walls of each connector. These conductors are then crimped in a crimping zone by means of simultaneous transverse punching of at least one wall of a connector. This transverse punching forms at least one corresponding transverse groove line on said at least one connector wall and, by means of load transfer, on each of the conductors.

According to preferred embodiments:

the punching is carried out by uniform pressing of a rib on at least one wall of the connector;

the punching is alternated so that the transverse grooves are interleaved in order to form an undulating routing for the conductors in the connectors;

the ribs and the corresponding grooves are cylindrical.

The present invention also relates to a crimping tool which comprises two shells, each shell having a main wall which forms an inner face which is provided with at least one transverse rib, each shell also having end edges which are folded over perpendicularly relative to the walls so as to define an inner space. In this space, a connector of conductors which are arranged perpendicularly relative to the ribs may be introduced in order to implement the method for connection by means of crimping defined above.

Preferably, the crimping tool comprises two ribs on the inner face of a shell and a rib which is interleaved between the other two ribs on the inner face of the other shell which is arranged opposite during the crimping operation.

The invention also relates to a multi-point modular connector for connecting a layer of parallel conductors to a metal current return component. Such a connector comprises internal longitudinal cells for accommodating the conductors, said cells being formed by two inner wall faces which extend longitudinally. At least one crimping groove of the conductors extends transversely over at least one inner wall face. This connector also comprises means for connection to metal current return components, said means being fixed by at least one opening which is formed in the walls.

According to preferred embodiments:

the connector is a terminal connector in which the blind cells open at the end at a transverse face;

the fixing means are then arranged at an end different from the output face of the cells, in particular at an end opposite this output face;

the connector is an intermediate connector in which the cells are through-cells and open at the end at two transverse faces;

the connection means are arranged in a central zone of the walls of the connector.

According to advantageous embodiments:

the connectors are of aluminium alloy of low resistivity;

the connectors are surface-treated, in particular by means of nickel-coating, tin-coating, silver-coating or the like, in order to produce an assembly by means of reinforcement with tight fitting with respect to the corresponding components to be connected in order to prevent galvanic corrosion;

the cells have at the end chamfered surfaces in order to facilitate the insertion of the conductors;

the intermediate connectors which are connected to the layer and to the components to be connected are inserted at any location of the layer between two terminal connectors;

the terminal and intermediate connectors have a thickness which is hardly greater than the diameter of the conductors.

The invention also relates to a connection wiring loom which is capable of connecting metal current return components. This wiring loom comprises parallel conductors which form a planar and flexible layer, terminal and intermediate multi-point modular connectors defined above for connection to said metal components, and a casing which covers the layer and the connection between the layer and the connectors.

According to specific embodiments:

each conductor consists of a plurality of elementary strands of aluminium which are assembled in a cord and the conductors are assembled with each other by means of connections which are perpendicular relative to the conductors and which are distributed along the layer;

the casing is made from a PVF material (polyvinyl fluoride) or PTFE material (polytetrafluoroethylene);

the casing comprises fluid-tight flexible insulating films for covering the conductor layer and a thermo-retractable sheath coated with fluid-tight product.

DESCRIPTION OF THE FIGURES

Other aspects and features of the implementation of the invention will emerge from the following detailed description, accompanied by accompanying drawings in which:

FIG. 6*a* to 6*d* are front views (FIGS. 6*a* and 6*c*) and sectional views (FIGS. 6*b* and 6*d*), before and after crimping respectively, of an example of a tool for crimping conductors in a connector according to the invention;

FIG. 7*a* to 7*d* are perspective views (FIGS. 7*a* and 7*b*), a front view (FIG. 7*c*) and a sectional view (FIG. 7*d*) of another example of a tool for crimping conductors in a connector according to the invention, and FIGS. 8*a* and 8*b* are a perspective view and a sectional view of a terminal connector after crimping of the conductors using the tool according to FIG. 7*a* to 7*d*, respectively.

DETAILED DESCRIPTION

Identical reference signs used in the various figures relate to elements which are identical or technically equivalent. The terms "upper", "central" and "lower" refer to the relative positioning during standard use or assembly mode. The terms "longitudinal" and "transverse" refer to elements which extend respectively in a given direction and along a plane which is perpendicular to this direction, in particular "longitudinal" refers to the fuselage axis of an aircraft.

Figure 2B:
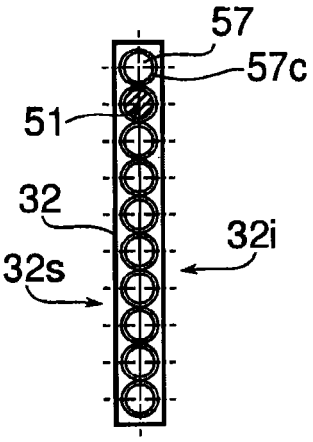
FIG. 2*a* to 2*c* are a front view and cross-sections along II-II and II'-II' of an example of a terminal connector according to the invention.
Figure 2A:
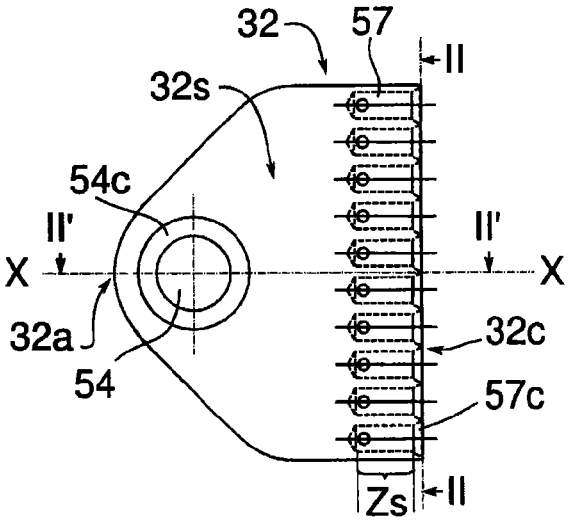
Figure 2C:
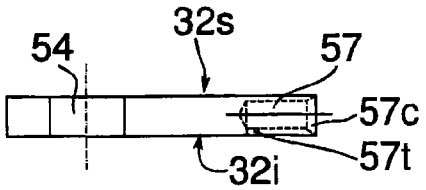

The terminal connectors 32, as illustrated by the front and sectional views II-II and II'-II' of FIG. 2*a* to 2*c*, comprise an upper wall 32*s* and a lower wall 32*i* between which individual aligned cells 57 extend from a side 32*c* and over the entire length of said side. Each cell 57 is capable of receiving a conductor end in order to be crimped over the entire length thereof. A chamfer 57*c* is provided at the input of each cell 57 in order to facilitate the insertion of the conductor and to keep the cohesion of the aluminium strands of the conductors 51 (FIG. 5) together when the conductors 51 are inserted into their individual cell. One or more strands of aluminium are thus prevented from remaining outside the cell to be crimped. In the case of the terminal connectors 32, the cells 57 are blind cavities.

The terminal connectors 32 are connected to the metal support components 11 and metal transverse components 14 (FIG. 1) for current return via appropriate fixings and interfaces. The range of electrical contact 54*c* which surrounds the fixing opening 54 is extended in order not to exceed predetermined heating limits as a result of the Joule effect.

The terminal connector illustrated has a longitudinal axis of symmetry X'X with a pointed tip 32*a*, the opening 54 being produced substantially at the centre of this end. Such a fixing interface may receive a bending, a folding through a given angle, etc. According to other variants, the interface may be of the rapid disconnection type, via a ¼ turn or the like.

Figure 1:
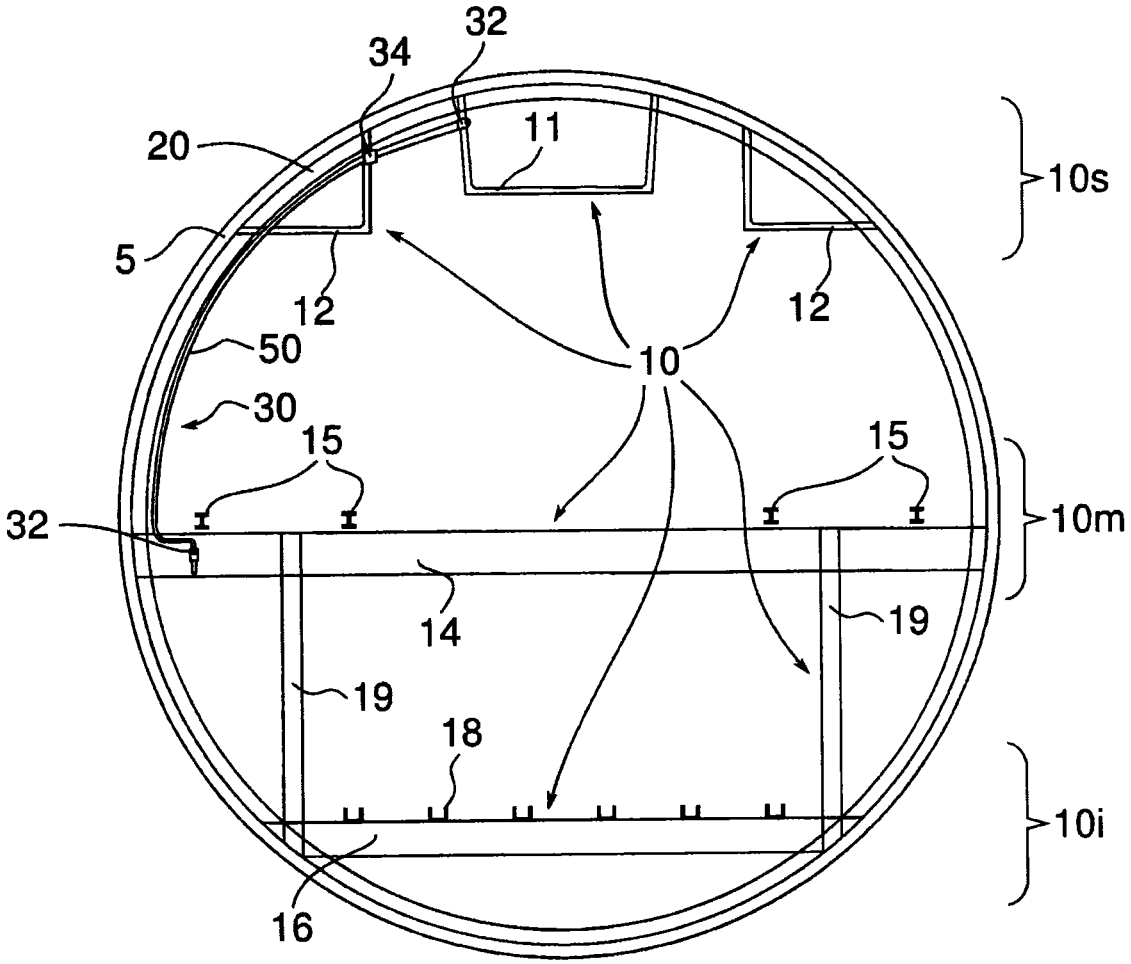
FIG. 1 is a transverse cross-sectional view of a portion of an aircraft passenger cabin provided with an example of a wiring loom according to the prior art (already discussed)
Figure 3A:
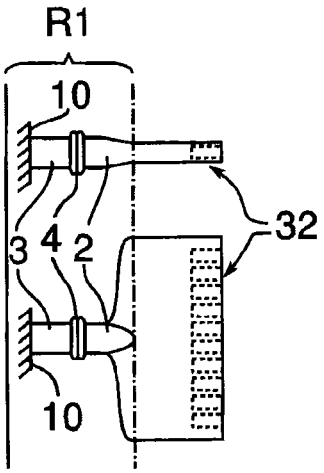
FIG. 3*a* to 3*c* are side and upper views of schematic examples of connectors of a terminal connector according to the invention in the current return network.
Figure 3B:
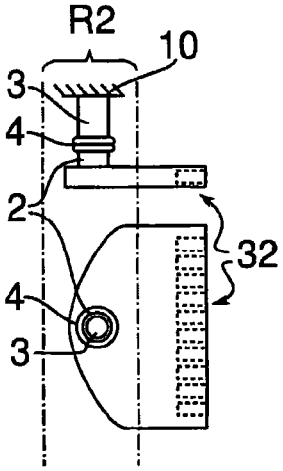
Figure 3C:
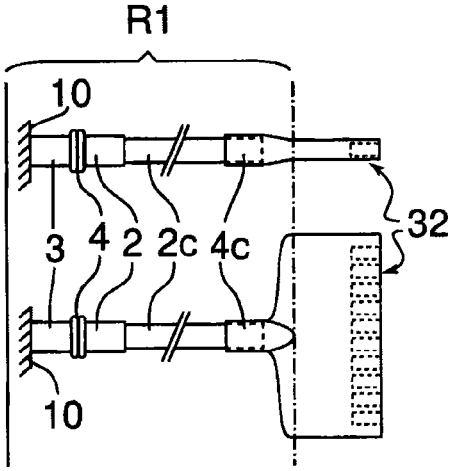

In the schematic examples illustrated by the side and upper views of FIG. 3*a* to 3*c*, the connections are of the rapid disassembly type in order to produce a connection/disconnection, for example, in less than 10 seconds. The connections R1, R2, R3 are thus formed of two portions: a portion 2 of the connector which cannot be disassembled from the terminal connector 32 replaces the system of connection via an opening 54. The geometry of the tip 32*a* (FIG. 2*a*) is modified locally in order to adapt said portion 2 of the rapid connection/disconnection system. The complementary portion 3 which is assembled by means 4 for screwing or clip-fitting on the portion 2 is then installed on a current return element 10 (FIG. 1). In another embodiment, a first portion of said portion 2 is formed, for example, by a cable 2*c* (FIG. 3*c*) and can be assembled using crimping means 4*c* on the terminal connector 32.

Figures 4A, 4B:
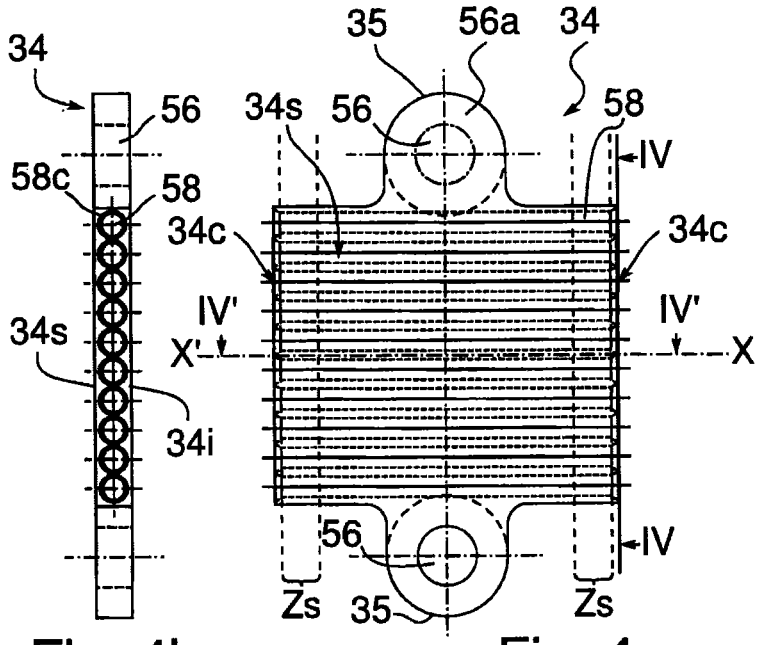
FIG. 4*a* to 4*c* are a front view and cross-sections along IV-IV and IV'-IV' of an example of a multi-point intermediate connector.
Figure 4C:
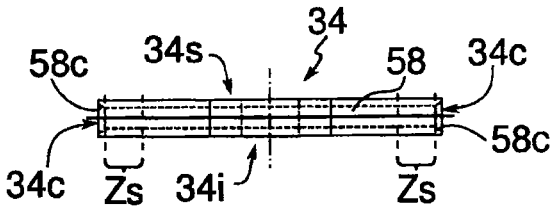

With regard to the intermediate connectors 34, a front view and sectional views IV-IV and IV'-IV' are illustrated in FIG. 4*a* to 4*c*, respectively.

This connector comprises an upper wall 34*s* and lower wall 34*i* between which cells 58 extend over the entire length of the sides 34*c*. The cells 58 are formed by longitudinally continuous cavities which extend through the connector 34 from one side to the other. These cavities are terminated with chamfers 58*c* which facilitate the access of the conductors in the cells 58.

Figure 5:
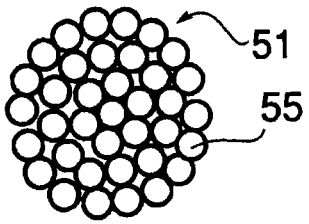
FIG. 5 is a transverse cross-section of one of the layer-type conductors to be crimped in a connector.

The conductors 51, such as the one illustrated in cross-section in FIG. 5, are inserted individually into the cells 58 without any cutting, which brings about a contact resistance increase and an increase in the reliability of the connection. The conductors are crimped in the cells in crimping zones Zs which are formed close to one and/or other of the sides 34*c* of the connector 34.

The interface of the intermediate connector 34 with the metal components of the aircraft is adapted to specific needs. In this manner, the intermediate connectors 34 may have a single tip 35 having a fixing opening 56 or, as illustrated, two tips 35 which are symmetrical relative to the longitudinal axis X'-X', having two fixing openings 56. The extent of the range of electrical contact 56*a* which surrounds the fixing opening 56 is optimised in terms of heat discharge and the fixings are carried out by means of screwing or the like through the openings 56.

As for the terminal connectors, this interface may receive a bending, folding at a given angle or the like. Also, other variants of this interface may be of the rapid disconnection type, ¼ turn or the like. Advantageously, these intermediate connectors 34 allow a current return cable of an item of equipment to be connected closest to this item of equipment, forming a branching "T", for example, using the connections R1 to R3 illustrated in FIG. 3*a* to 3*c*.

In this manner, the interface of the multi-point intermediate connector 34 with the planar layer is produced by means of insertion and crimping of each conductor in an individual cell 58. Each conductor 51 is formed of elementary strands 55 of aluminium which are assembled to form a cord, as illustrated by the sectional view of FIG. 5. The conductor set out by way of example is a calibrated gauge AWG12 which has an outer diameter of approximately 2 mm.

When a given layer is placed in position, dedicated tools allow each layer portion to be cut and crimped in the connectors 32 and 34 in order to produce the desired wiring loom. The connection of the wiring loom can thus be adapted in accordance with the configuration and the dimensions of the installation to be produced. In particular, this connection can be adapted to the resistivity of the connection to be connected, of the transit or excess current, of the number of fixing locations and the spatial requirement of the installation and the number of components to be connected.

The geometry of the connectors allows their total mass to be reduced to an absolute minimum. In particular, the thickness of the connectors 32 and 34 between their walls is just at the maximum diameter of the conductors 51 whilst remaining sufficient to retain a strength which is compatible with the presence of the cells.

The connectors are advantageously formed of an aluminium alloy for electrical use, and therefore have low resistivity. A surface-treatment for the connectors (nickel-coating, tin-coating, etc.) is preferably carried out so that this surface has low resistivity and forms electrical connections at an interface with tight fitting by means of reinforcement with the supports 11, 12, and the cross-members 14, 16 which have to be connected (cf. FIG. 1). In this manner, the risks of galvanic corrosion in the region of the electrical connection are eliminated.

The layer is also modular in order to facilitate its adaptability: the number of conductors 51, the cross section thereof, the dimensions of the connectors, the number of intermediate connectors, the thickness and the width of the layer can be adjusted. Furthermore, the electrical and mechanical connection interfaces can be adapted to the component to be connected.

The finishing in the region of the terminal connectors 32 and intermediate connectors 34 is ensured by portions of a heat-shrinkable polyolefin sheath or the like. This contracted external finishing casing, straddling the space between each connector and the planar layer, thus mechanically protects the crimping operations and the projecting portion of the conductors by completely covering this connector/conductor interface. This outer finishing casing is, in another example, produced by means of localised overmoulding, at low or high pressure.

With more specific reference to the crimping of the conductors 51 in each connector cell, this is carried out by means of a dedicated tool. According to the invention, such a tool applies simultaneous and uniform pressure to the walls 32*s* and 32*i* of the terminal connectors 32 (or between the walls 34*s* and 34*i* of the intermediate connectors 34), in order to optimise the connection by minimising the plastic deformation and the movement of the material of the connectors. Advantageously, the control of the crimping pressure does not bring about any splitting in the connector 32.

The crimping of all the cells 57 is carried out simultaneously and in a single operation. The crimping compresses and deforms the individual strands of the conductors 51 but does not change the equivalent cross section of conductive material of the conductors.

The length of elementary crimping is such that the traction force which it is necessary to apply to a conductor 51 in order to make it slide or remove it from its crimping is greater than the elastic limit of this conductor.

Advantageously, the conductors are not destranded before crimping. The electrical resistance of an elementary crimping is less than or equal to the electrical resistance of the conductor length equivalent to the length of crimping.

Suitable surface treatment of the conductors 51—by means of nickel-coating, tin-coating, silver-coating or the like—allows electrochemical compatibility with that of the connectors, and the surface treatments are not destroyed by the crimping.

With reference to the front and sectional views of FIGS. 6*a* and 6*b*, an example of a crimping tool 21 according to the invention comprises two shells, a shell referred to as an upper shell 21*s* and a shell referred to as a lower shell 21*i*. Each shell is composed of a main wall P1 which forms an inner face F1 and end edges B1 which are folded down (at least on one shell) perpendicularly to the main wall P1 so as to define an inner space E1. The inner face F1 of the upper wall 21*s* is provided with a transverse rib N1. In preparation for the crimping, the connector 32 is introduced into the space E1 so that the shells 21*s* and 21*i* are arranged at one side and the other of the walls 32*s* and 32*i* of the connector 32 to be crimped, a terminal connector in the example.

The rib N1 of the shell 21*s*, which is positioned transversely, is located approximately mid-way in respect of the portion 51*p* of the conductors 51 which is located in the cells 57. This positioning is also suitable for crimping the conductors in an intermediate connector according to the invention.

During the crimping operation, the same pressure Ps is applied to each shell 21*s* and 21*i* of the tool 21 in order to move the two shells 21*s* and 21*i* together until they contact the edges B1, as illustrated by FIGS. 6*c* and 6*d*. The rib N1 is introduced in a uniform and simultaneous manner into the wall 32*s* of the connector 32, forms a transverse cylindrical groove Rc in said wall 32*s* and, by means of load transfer, compresses and deforms the conductors 51.

According to another example of a crimping tool, with reference to the perspective FIGS. 7*a* and 7*b*, the upper shell 22*s* of the tool 22 has, as above, a transverse rib N1. The inner face F2 of the lower shell 22*i* has two transverse ribs N2 and N3. Under these conditions, when the conductors 51 of a connector 32 are crimped, as illustrated in greater detail by FIGS. 7*c* and 7*d*, the rib N1 is located so as to be interleaved between the ribs N2 and N3. The application of the pressures Ps to the shells 22*s* and 22*i* brings about a uniform and simultaneous introduction of the ribs N1 to N3 into the walls 32*s* and 32*i* of the connector 32.

As illustrated by the perspective and sectional views of the connector 32 in FIGS. 8*a* and 8*b*, grooves Rc are thus formed on the walls 32*s* and 32*i* of the connector 32. In order to better visualise the two parallel grooves formed on the lower wall 32*i*, the connector 32 is shown in an inverted manner in FIGS. 8*a* and 8*b* relative to standard use. By means of load transfer from the grooves Rc, the strands 55 of the conductors 51 are compressed and deformed alternately in order to have an undulating shape.

After crimping, the electrical and mechanical performance levels are achieved:

- the value of the electrical resistance of a crimping is strictly less than the value of electrical resistance of a length of conductor equivalent to the length of the crimping (set out above);
- in a given connector, the electrical resistances of the crimpings are all located in a range of variation from each other in the order of approximately 5%, which allows the flow of non-homogeneous currents to be prevented in the conductors 51;
- the value of the traction resistance is at least equal to the value of the elastic limit of the conductor 51.

The invention is not limited to the embodiments described and illustrated. It is, for example, possible to provide hybrid intermediate connectors which are partly formed by through-cavities and by blind cells in order to accommodate the conductors. Furthermore, the conductors are preferably of aluminium alloy but could also optionally be of copper alloy or titanium alloy.

The invention claimed is:

1. A method for electrically connecting by crimping electrical conductors in a connector for equipotential connection of a planar and flexible layer formed by the conductors, to metal components, the method comprising:

positioning the electrical conductors in individual longitudinal and parallel cells which are formed between two planar walls of the connector;

crimping the conductors crimped in a crimping zone by simultaneous transverse punching of at least one wall of the connector; and forming by the transverse punching at least one corresponding transverse groove line on the at least one wall of the connector and, by load transfer, on each of the conductors to electrically connect the conductors.

2. The electrical connection method according to claim 1, wherein the punching is carried out by uniform pressing of a rib on at least one of the planar walls of the connector.

3. The electrical connection method according to claim 2, wherein the rib and the at least one corresponding transverse groove line are cylindrical.

4. The electrical connection method according to claim 1, wherein the punching is carried out by uniform pressing of ribs on the two planar walls of the connector, and the ribs are alternated so that the corresponding transverse groove lines are interleaved to form an undulating routing for the conductors in the connector.

5. The electrical connection method according to claim 4, wherein the ribs and the corresponding groove lines are cylindrical.

6. The electrical connection method according to claim 1, wherein the connector is formed of aluminum alloy.

* * * * *